US011188030B2

(12) United States Patent
Zaugg et al.

(10) Patent No.: US 11,188,030 B2
(45) Date of Patent: Nov. 30, 2021

(54) REGULATED JUMPING DISPLAY MECHANISM FOR TIMEPIECES

(71) Applicant: Montres Breguet S.A., L'Abbaye (CH)

(72) Inventors: Alain Zaugg, Le Sentier (CH); Christophe Riedo, Le Lieu (CH)

(73) Assignee: Montres Breguet S.A., L'Abbaye (CH)

( * ) Notice: Subject to any disclaimer, the term of this patent is extended or adjusted under 35 U.S.C. 154(b) by 448 days.

(21) Appl. No.: 16/299,182

(22) Filed: Mar. 12, 2019

(65) Prior Publication Data

US 2019/0286058 A1 Sep. 19, 2019

(30) Foreign Application Priority Data

Mar. 13, 2018 (EP) ..... 18161514

(51) Int. Cl.
*G04B 19/253* (2006.01)
*G04B 19/02* (2006.01)

(52) U.S. Cl.
CPC ..... *G04B 19/25353* (2013.01); *G04B 19/02* (2013.01); *G04B 19/25393* (2013.01)

(58) Field of Classification Search
CPC . G04B 19/253; G04B 19/25353; G04B 19/02
See application file for complete search history.

(56) References Cited

U.S. PATENT DOCUMENTS 5,784,342 A * 7/1998 Genta ..... G04B 19/082 368/110
6,826,122 B2 * 11/2004 Zaugg ..... G04B 19/23 368/28
7,961,560 B2 * 6/2011 Hiraga ..... G04B 19/241 368/220
8,588,031 B2 * 11/2013 Goeller ..... G04B 19/262 368/17

(Continued)

FOREIGN PATENT DOCUMENTS

CH 203 181 2/1939
WO WO 2017/158536 A1 9/2017

OTHER PUBLICATIONS

Combined Chinese Office Action and Search Report dated Jul. 31, 2020 in corresponding Chinese Patent Application No. 201910184994.X (with English Translation of Category of Cited Documents), 7 pages.

(Continued)

*Primary Examiner* — Sean Kayes
(74) *Attorney, Agent, or Firm* — Oblon, McClelland, Maier & Neustadt, L.L.P.

(57) ABSTRACT

A timepiece display mechanism including a barrel with a spring between the arbor of a first wheel set driven by a drive wheel set, and a drum carrying a peripheral snail cam traversed by a feeler controlling the periodic jump of a display member, this drum carrying an peripheral finger outside the trajectory of this feeler, this first wheel set including an eccentric crank pin permanently guiding a (Continued)

groove to control the periodic back and forth motions of a pivoting anchor piece, which includes, on either side of an anchor piece axis, a beak and a stop for stopping or releasing this finger depending on the angular position of this anchor piece, the angular travel of each finger between its release by this beak and return to abutment on this stop defining the jump duration.

14 Claims, 5 Drawing Sheets

(56) References Cited

U.S. PATENT DOCUMENTS

| | | | |
|---|---|---|---|
| 8,995,233 | B2 | 3/2015 | Goeller et al. |
| 2014/0126336 | A1 | 5/2014 | Goeller et al. |

OTHER PUBLICATIONS

European Search Report dated Sep. 17, 2018 in European Application 18161514.7, filed on Mar. 13, 2018 (with English Translation of Categories of Cited Documents and Written Opinion).

* cited by examiner

REGULATED JUMPING DISPLAY MECHANISM FOR TIMEPIECES

CROSS-REFERENCE TO RELATED APPLICATION

This application claims priority to European Patent Application No. 18161514.7 filed on Mar. 13, 2018, the entire disclosure of which is hereby incorporated herein by reference.

FIELD OF THE INVENTION

The invention concerns a timepiece display mechanism comprising at least one display member that moves in jumps, said mechanism comprising at least one spring between a first wheel set and a second wheel set, said first wheel set or respectively said second wheel set being arranged to be driven a drive wheel set.

The invention also concerns a timepiece movement including such a display mechanism.

The invention also concerns a watch including such a timepiece movement and/or such a display mechanism.

The invention concerns the field of timepiece display mechanisms, in particular for watches.

BACKGROUND OF THE INVENTION

Movements provided with a date mechanism are provided with various drive mechanisms:

directly driven mechanisms;

semi-instantaneous mechanisms;

instantaneous mechanisms.

An example of a directly driven mechanism is described in the book "Les montres compliquées" (Complicated watches) by Francois Lecoultre (Ed. Simonin) in the chapters entitled "Quantième simple" (Simple calendar mechanism) and "Quantième perpétuel traînant" (Continuous-type perpetual calendar).

Semi-instantaneous mechanisms are very common, since they are of simple structure; a flexible finger is armed on the date drive wheel until the date jumper jumps, only the second part of the jump is therefore instantaneous. This structure is found in the main commercial watch movements, notably the following: ETA 2824, 2892, Breguet 7700, 1050, 7875, Blancpain 1150, 1180, 1280.

An example of an instantaneous mechanism is described in the book Les montres compliquées" (Complicated watches) by Francois Lecoultre (Ed. Simonin) in the chapter entitled "Quantième perpétuel instantané" (Instantaneous perpetual calendar). Other structures exist with systems for winding/arming a spring during part of the day and activation at midnight, which releases the spring to perform the date indicator driving function. Movements of this type exist on the market, for example the Breguet 8810 or the Blancpain 6950 movement.

When complex instantaneous date mechanisms are made, for example perpetual calendars or large aperture or roller date displays, instantaneous release causes the components to move at high speeds. The dynamic stresses applied to the components become noticeable due to their inertia: high speed combined with high inertia produces high stresses, which are non-existent in the case of a directly driven function (which takes one to several hours), and operating disruptions may occur, for example double jumps may be made.

The same issue affects other displays where the display changes with a jump than the particular case described above of a date display, for example AM/PM or day/night displays, or any retrograde display.

Swiss Patent Application No CH203181A in the name of BROWN discloses a sidereal time-keeper indicating the arc degrees on three discs, respectively for the units, tens and hundreds, wherein the tens disc bears only the seven numerals 0 to 6, and is associated with a concentric sector which bears the numerals 7, 8 and 9, and which is connected to the disc in question with play allowing this sector to be driven through three divisions in succession by the units disc, at the end of three out of four revolutions of the tens disc, which then remains immobile. A device, actuated on the fourth revolution of the tens disc by the rotation of said disc, removes the connection with the sector and at the same time causes a retractable tooth to appear at the edge of the tens disc, which allows the units disc to drive the tens disc in quick succession through two divisions, for the indications 360 and then 001.

SUMMARY OF THE INVENTION

For a display mechanism where the display changes with a jump, such as in particular but not exclusively a complex date mechanism, such as a perpetual calendar, or large aperture or roller date display, it is advantageous to have an instantaneous date change at midnight that is visible to the user for several seconds. For example, a change from 28 February to 1st March that takes 3 to 4 seconds. This reduced notion of instantness becomes qualitative.

The present invention proposes to develop a regulated display drive device wherein the jump can be seen by the user, and is more particularly described for a regulated date display mechanism.

To this end, the invention concerns a timepiece display mechanism with a display member that moves in jumps according to claim 1.

The invention also concerns a timepiece movement including such a display mechanism.

The invention also concerns a watch including such a timepiece movement and/or such a display mechanism.

BRIEF DESCRIPTION OF THE DRAWINGS

Other features and advantages of the invention will appear from reading the following detailed description, with reference to the annexed drawings, in which.

DETAILED DESCRIPTION OF PREFERRED EMBODIMENTS

Figure 1:
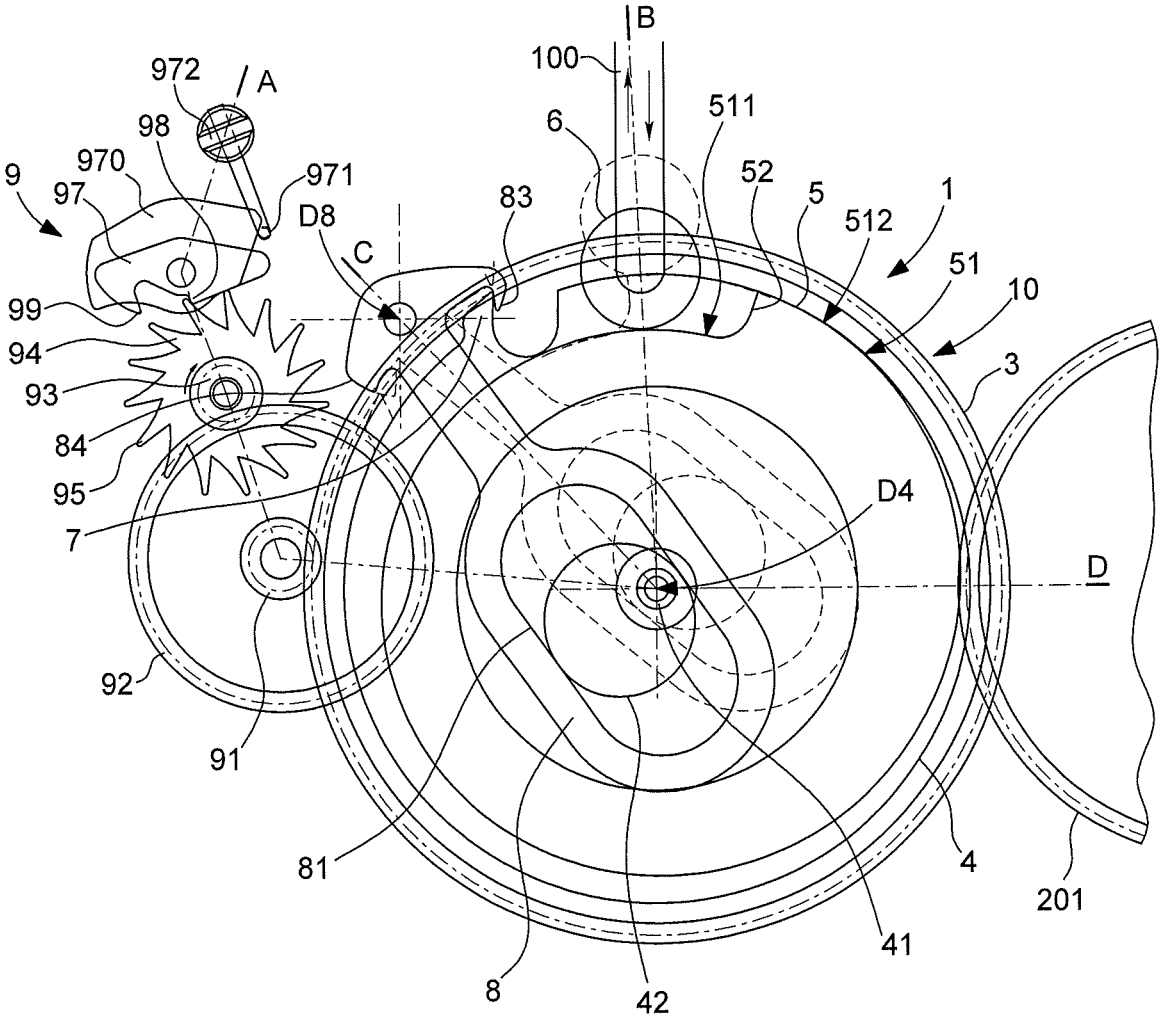
FIG. 1 represents a schematic, plan view of the timepiece display mechanism with a display member that moves in jumps according to the invention, as it appears mid-afternoon. This mechanism includes a barrel with a spring between the arbor of a first wheel set driven by the movement, and a drum carrying a peripheral snail cam traversed by a runner controlling the jump, which is a periodic jump here, of a display member. The drum carries a peripheral finger, which is arranged to cooperate, depending on the case, with a stop or a beak of a pivoting anchor piece whose pivoting is controlled by an eccentric of the first wheel set; free rotation of the drum is braked by a regulating mechanism in the left part of the Figure.
Figure 2A:
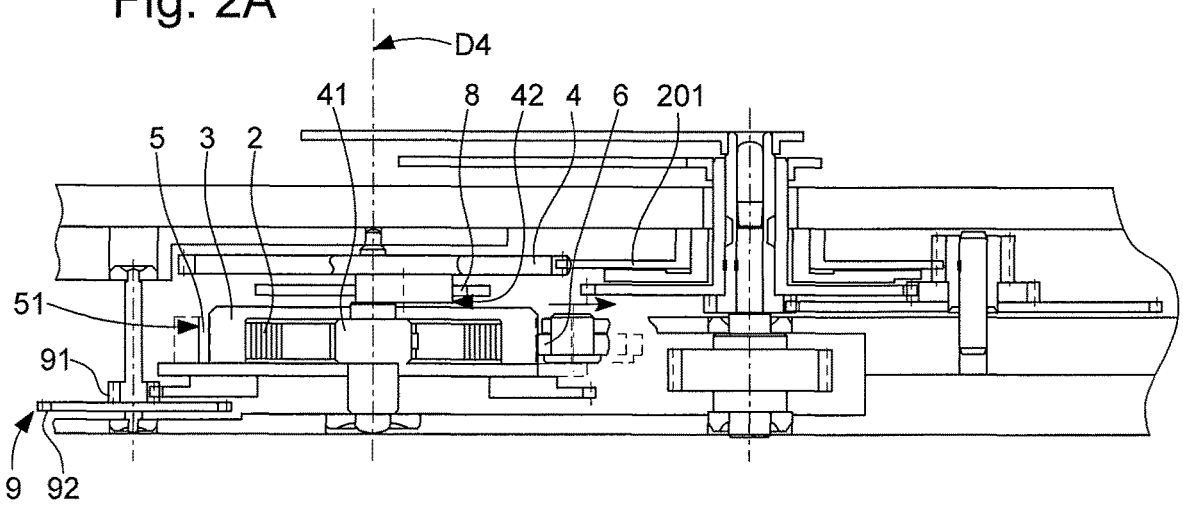
FIG. 2 is a cross-section of the mechanism of FIG. 1, taken along lines A-B and A-D of FIG. 1, part 2A more particularly represents the area of the drum, anchor piece and roller, and FIG. 2B more particularly represents the regulating mechanism area.
Figure 2B:
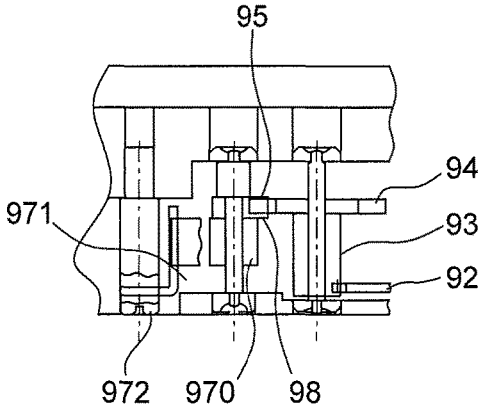
Figure 3:
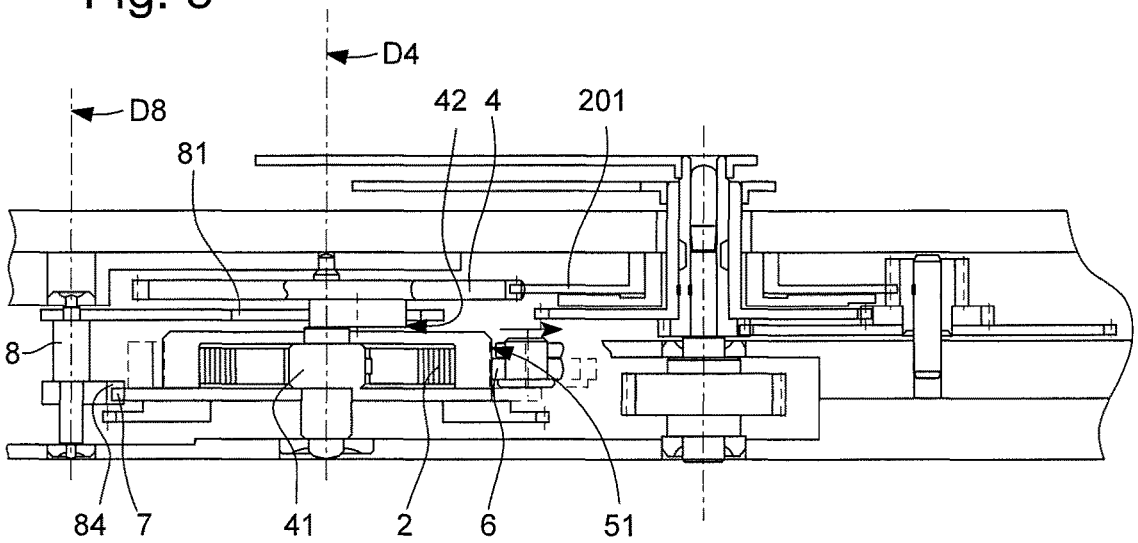
FIG. 3 is a cross-section of the mechanism of FIG. 1, taken along the line B-C of FIG. 1.

The invention concerns a timepiece display mechanism 1 with a display member 100 that moves in jumps. More particularly, this display member moves in periodic jumps. This is the case of the embodiment illustrated by the Figures.

This mechanism 1 comprises at least one spring 2 between a first wheel set 4 and a second wheel set 30. This first wheel set 4, or respectively second wheel set 30, is arranged to be driven by a drive wheel set 201, comprised either in the display mechanism itself, or in an external mechanism, such as a movement 500 or similar.

According to the invention, the wheel set that is not directly driven by drive wheel set 201, i.e. second wheel set 30, or respectively first wheel set 4, is arranged to drive or carry a cam 5.

More particularly, this cam 5 is a peripheral snail cam 51, which is traversed by a feeler 6, which is arranged to control the jump, and particularly the periodic jump, of such a display member 100.

Mechanism 1 includes locking/release means 70, which include, on the one hand at least one finger 7 driven by second wheel set 30, or respectively first wheel set 4, and on the other hand a third wheel set 80, which is arranged, depending on its angular position, to stop or release this at least one finger 7, to prevent or respectively allow rotation of cam 5.

The function of this cam 5 is to impose travel of a certain duration on feeler 6, to produce a display change that is clearly visible to the user: the jump is thus spread out over several seconds, corresponding to the longest possible travel path at the edge of the cam.

To make this display change occur as uniformly as possible, advantageously, mechanism 1 includes a regulating mechanism 9 for regulating the rotational speed of the wheel set that carries cam 5: this regulating mechanism 9 includes, in particular, in the illustrated version, a regulating train, which meshes with that of second wheel set 30, or respectively of first wheel set 4 which drives or carries cam 5 to limit its rotational speed when finger 7 is released.

More particularly, in the non-limiting embodiment illustrated in the Figures, mechanism 1 includes at least one spring 2 wound between, on the one hand, an arbor 41 of first wheel set 4, and on the other hand, second wheel set 30. More particularly still, this second wheel set 30 is a drum 3, which carries at least one peripheral finger 7, with no interference with the trajectory of feeler 6 and notably outside the trajectory of feeler 6. This drum 3 carries a peripheral cam 5, which includes, more particularly, at least one zero reset threshold 52 after a jump of display member 100, and is, more particularly, but not necessarily, a snail 51. Cam 5 is traversed by a feeler 6 arranged to control the jump, in particular the periodic jump, of a display member 100, especially but not exclusively a date display member.

In the illustrated embodiment, snail 51 includes a long ramp, which extends from a lower level 511 to an upper level 512, and a single threshold 52. Feeler 6 is a runner in the non limiting variant illustrated by the Figures. In other non-illustrated variants, this feeler may be a single finger that rubs over the cam profile, or otherwise.

In other non-illustrated variants, the snail may include, on its circumference, an alternation of such ramps and such thresholds. More particularly but not exclusively, the angular sector corresponding to each ramp is identical.

In the illustrated embodiment, the third wheel set 80 is a stopper, and in particular an anchor piece 8, which is angularly movable about an anchor piece axis D8 under the action of first wheel set 4, or respectively of second wheel set 30. This anchor piece 8 is arranged, depending on its angular position, to stop or release said at least one finger 7, to prevent or respectively allow rotation of cam 5.

More particularly, first wheel set 4 includes an eccentric crank pin 42, which permanently guides a groove 81, comprised in a release anchor piece 8, for controlling the periodic back and forth motions of pivoting anchor piece 8. Anchor piece 8 includes, on either side of its anchor piece axis D8, a beak 83 and a stop 84 for stopping or releasing finger 7 depending on the angular position of anchor piece 8.

The angular travel of each finger 7 between its release by beak 83 and return to abutment on stop 84 defines the duration of the jump, i.e. of the change of display.

In the particular case illustrated by the Figures, there is only one finger 7.

In the particular case illustrated by the Figures, there is only one zero reset threshold 52 on cam 5.

In a particular application of the invention, illustrated by the Figures, mechanism 1 includes a barrel 10 comprising at least one such spring 2 between, on the one hand, the arbor of barrel 10, which is integral with arbor 41 of first wheel set 4, or which forms the latter, and on the other hand, drum 3.

However, this spring 2 can also be any suitable spring, the barrel spring is simply a particular case, which is well suited for industrial implementation of the invention.

In the non-limiting illustrated example, spring 2 is wound by drive wheel set 201, which is a 24-hour wheel or which is connected in a train to a 24-hour wheel. The spring can also be wound by a means other than the 24-hour wheel, for example an automatic winding train driven by an oscillating weight, a manual winding mechanism, or otherwise.

More particularly, first wheel set 4 pivots and is driven with an integer gear ratio by a drive wheel set 201.

The back and forth motion of anchor piece 8 defines an angular travel, relative to axis D4 of first wheel set 4, of each finger 7, between its release by beak 83 and its return to abutment on stop 84. This angular travel defines the jump duration, which corresponds to the duration of travel of feeler 6 on cam 5, firstly on a gentle ramp that gradually ascends from a lower level 511 to an upper level 512 of snail 51, then instantaneously drops back to lower level 511 on crossing zero reset threshold 52. This return to the lower level 511 position via the steep side of threshold 52 occurs instantaneously and without affecting the display, for example by means of a click finger system on a star, or suchlike.

Thus, each jump corresponds to a change of state of display member 100 between an earlier state and a later state, and the jump duration corresponds to the period of time that elapses between stable display of the earlier state and stable display of the later state.

More particularly, first input wheel set 4 is arranged to be driven by a continuous drive wheel set 201 and to accomplish, during one revolution of continuous drive wheel set 201, one revolution or an integer number of turns or a whole fraction of a turn.

A particular application of the invention is illustrated by the Figures.

Drive wheel set 201 is a 24-hour wheel providing energy and the time reference (one revolution in 24 hours) of a conventional timepiece movement.

This drive wheel 201 drives a first input wheel set 4 which is an additional 24-hour wheel here. This first input wheel set 4 carries an eccentric crank pin 42 and its arbor 41 is connected to a spring 2 of an additional barrel 3. This additional barrel 3 is therefore wound one turn every 24 hours here.

Eccentric crank pin 42 cooperates continuously with groove 81 of anchor piece 8, which is a straight oblong groove in the particular case of the Figures, of the additional 24-hour wheel. Release anchor piece 8 consequently makes one back and forth motion in 24 hours. It is understood that the illustrated example concerns a single daily jump at midnight for the particular case of a date, but it is possible to extrapolate the invention to any display having another period by adapting the gear ratios, the number of teeth 7 and their positions, the number of third wheel sets 80, particularly of anchor pieces 8, and/or the number of zero reset thresholds 52, to perform different jump functions.

For example, an application with two daily jumps at midday and at midnight can change the state of an AM/PM indicator, or an application with two daily jumps at 06:00 and at 18:00 can change the state of a day/night indicator.

Yet another application concerns a weekly display, with rotation in seven days and display of the day of the week. Many other applications are accessible and advantageous to those skilled in the art, since the invention provides novel visibility of the display changes, which constitutes a pleasant improvement for the user.

The back and forth motion of anchor piece 8 thus triggers rotation of drum 3, particularly drum 3 of barrel 10 in the case of the Figures, via its finger 7, at midnight to allow said drum to rotate through an angle of around 330°, and at midday through an additional 30°.

In a particular embodiment, eccentric crank pin 42 is assembled to arbor 41 by friction, in order to index the jump, for example at midnight for the date.

Rotation of drum 3 through 330° drives the display mechanism, particularly the date display, via cam 5, particularly a snail 51, which is attached thereto, and which applies a movement to feeler 6, which in the Figures is a runner of the date drive wheel, arranged to move display member 100. The subsequent display functions, particularly of the date, are performed in a known manner, for example in the form of a simple or perpetual calendar mechanism.

The additional 30° rotation is lost, this rotation is only required for the function of release anchor piece 8.

More particularly, in an advantageous manner, mechanism 1 is also connected to regulating mechanism 9, or includes a regulating mechanism 9. Drum 3 meshes with a train of regulating mechanism 9, notably in the variant illustrated by the Figures, with a pinion 91 of a regulating wheel 92, which meshes with an escape pinion 95, integral with a regulating escape wheel 94. Regulating wheel 92 is driven during rotation of drum 3. Regulating escape wheel 94 includes teeth 95, which are arranged to cooperate with a regulating pallet lever 97, which includes pallet stones 98 and 99. Under the torque imparted by drum 3, regulating pallet lever 97 alternately passes from one of its pallet stones to the other, driving an inertia weight 970 which is integral therewith. This oscillating motion of regulating pallet lever 97 has a natural frequency which, although not as isochronous as a balance/balance spring, can regulate a function properly. The oscillator frequency can be substantially modified with a complementary spring 971, mounted here to move on a screw head 972, which makes it possible to change the function time to a small extent.

Other variants of regulating mechanism 9 can also be used: a governor using inertia, centrifugal braking, magnetic braking, or eddy current braking, or otherwise.

It is this regulating system that limits the speed of the drum to 1 turn in around 2 to 8 seconds.

FIGS. 4 to 7 illustrate the sequence in the application described above.

Figure 4:
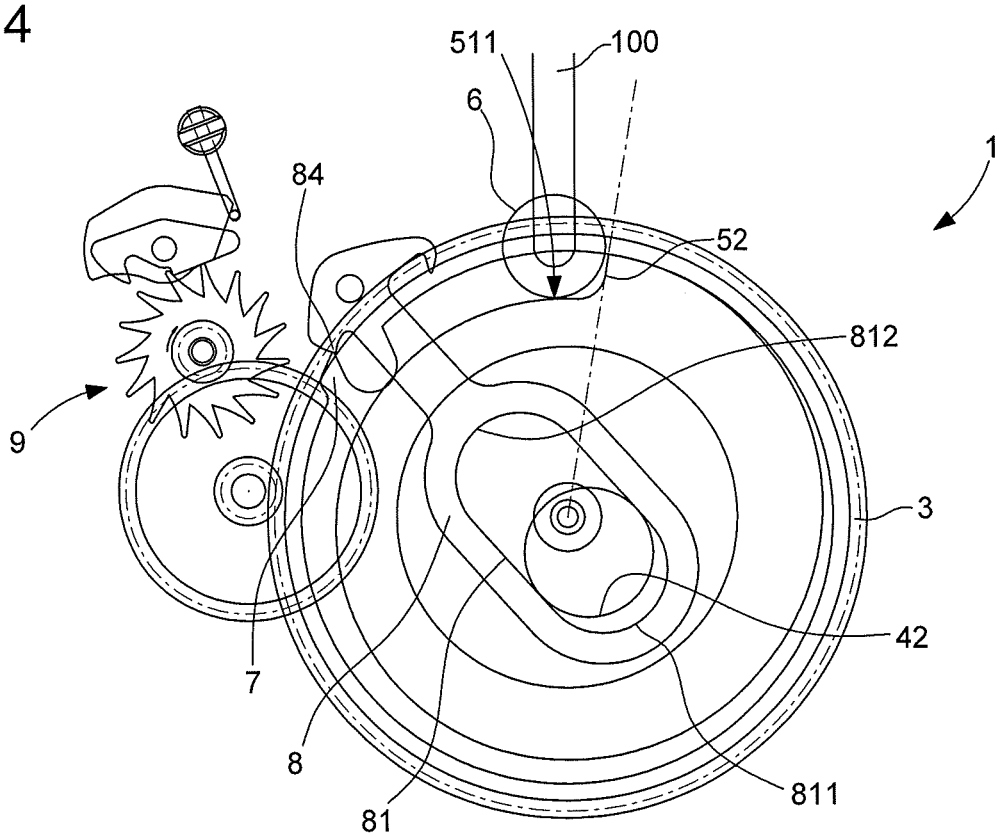
FIG. 4 represents, in a similar manner to FIG. 1, the same mechanism shortly before midday, at around 11:00.

FIG. 4 illustrates the state of the system shortly before midday, at around 11:00. Finger 7 is abuttingly engaged with stop 84 of anchor piece 8. Eccentric crank pin 52 is very close to a first end 811 of oblong groove 81 of anchor piece 8. The runner of feeler 6 rests on lower level 511 of snail 51, in immediate proximity to zero reset threshold 52, whose position is represented by a dot and dash radial line. The date drive system is thus inactive.

Figure 5:
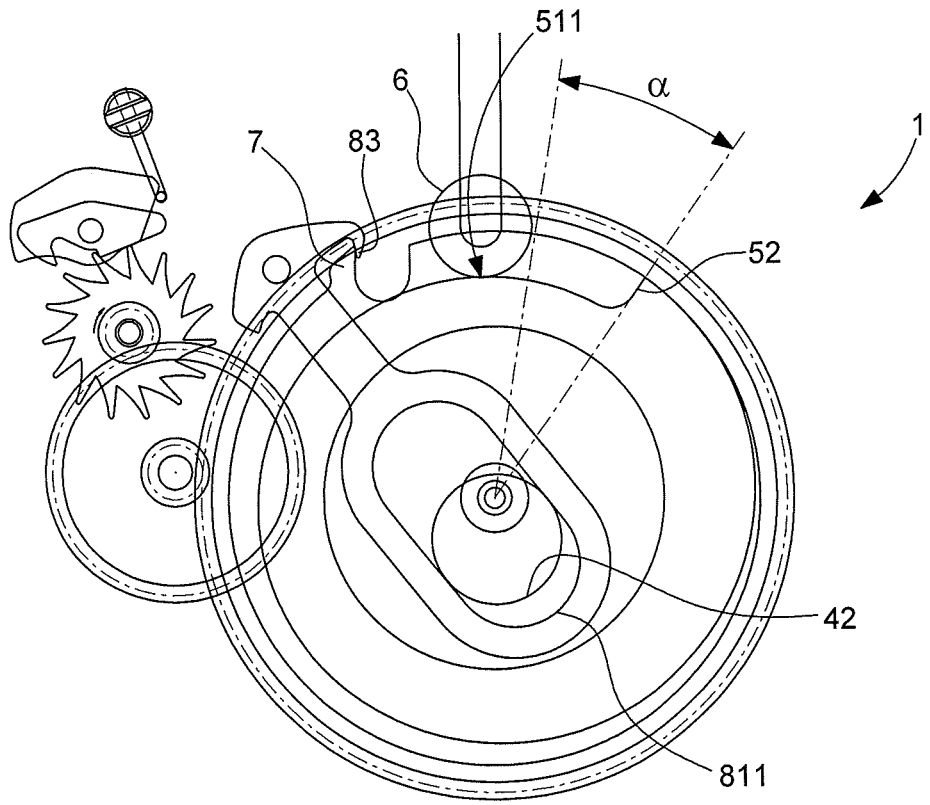
FIG. 5 represents, in a similar manner to FIG. 1, the same mechanism shortly after midday, at around 12:30.

FIG. 5 illustrates the state of the system shortly after midday, at around 12:30. Finger 7 is abuttingly engaged with beak 83 of anchor piece 8. Eccentric crank pin 52 is still close to first end 811 of oblong groove 81. The runner of feeler 6 rests on lower level 511 of snail 51, at an angular distance a, around 30° here, from zero reset threshold 52. The date drive mechanism is still inactive.

Figure 6:
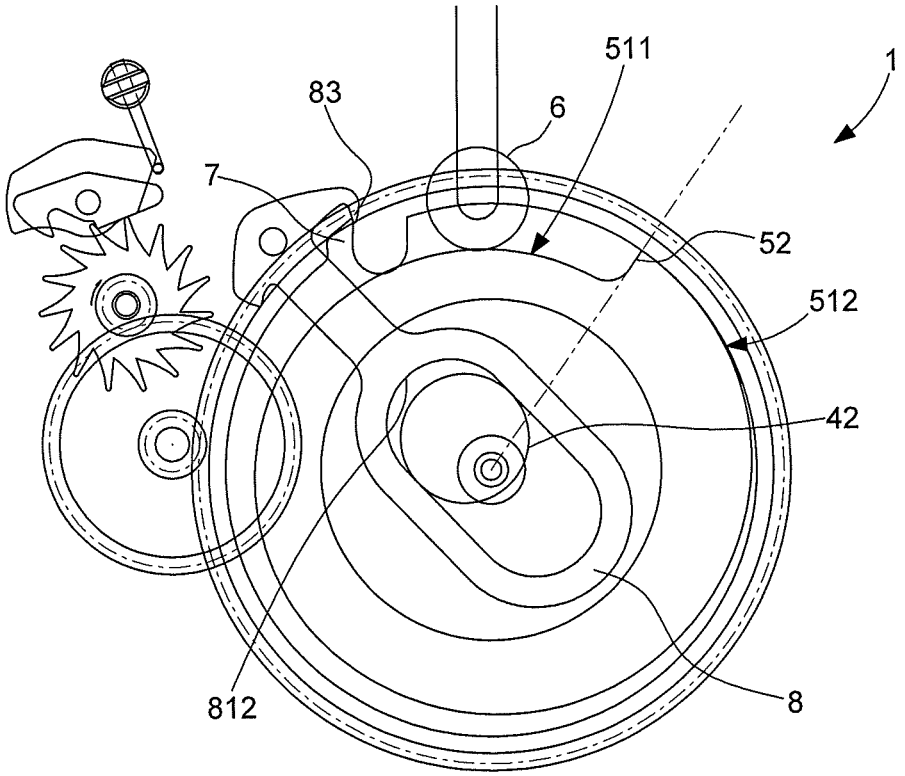
FIG. 6 represents, in a similar manner to FIG. 1, the same mechanism shortly before midnight, at around 23:00.

FIG. 6 illustrates the state of the system shortly before midnight, at around 23:00. Finger 7 is tip-to-tip with beak 83 of anchor piece 8: drum 3 will thus be able to be released, in order to rotate through almost one revolution, once this tip-to-tip contact has ended. Eccentric crank pin 52 has traversed oblong groove 81 of anchor piece 8 in the afternoon and is now very close to a second end 812 of this oblong groove 81. The runner of feeler 6 is still resting on lower level 511 of snail 51, in immediate proximity to zero reset threshold 52. The date drive mechanism is still inactive.

Shortly afterwards, at around midnight, finger 7 leaves beak 83 of anchor piece 8, drum 3 makes it rotation through an angle β, here of around 330°. During this rotation, which is regulated by regulating mechanism 9 detailed in FIG. 1, so that it lasts several seconds and is clearly visible to the user, the runner of feeler 6 firstly traverses lower level 511 of snail 51, then ascends to upper level 512, activating the date drive mechanism to display the new date. Runner 6 drops on passing zero reset threshold 52.

Figure 7:
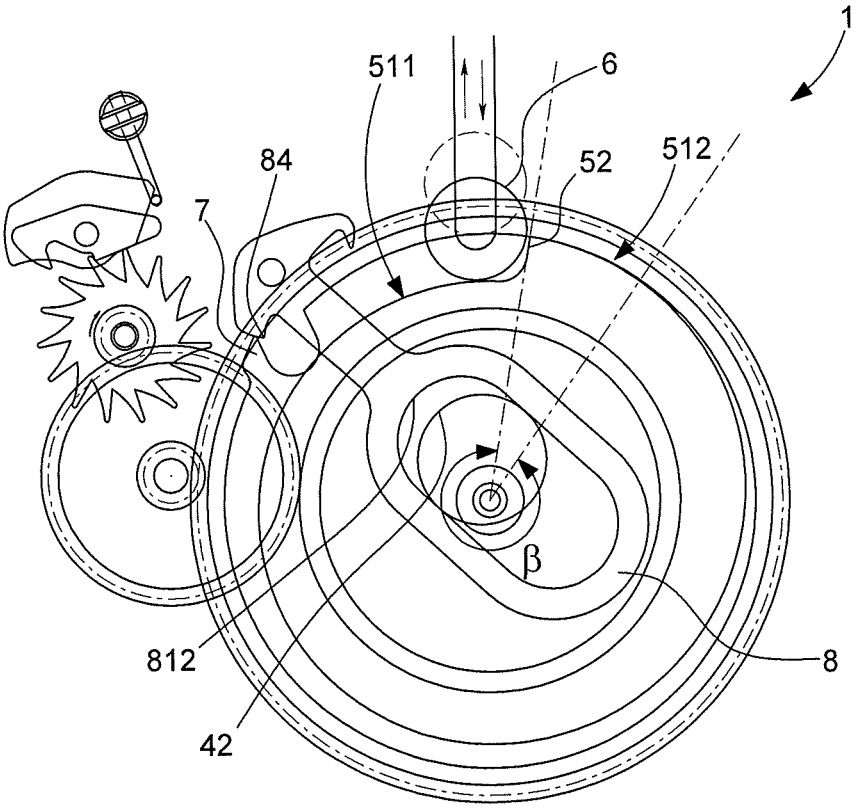
FIG. 7 represents, in a similar manner to FIG. 1, the same mechanism shortly after midnight, around 00.30.
Figure 8:
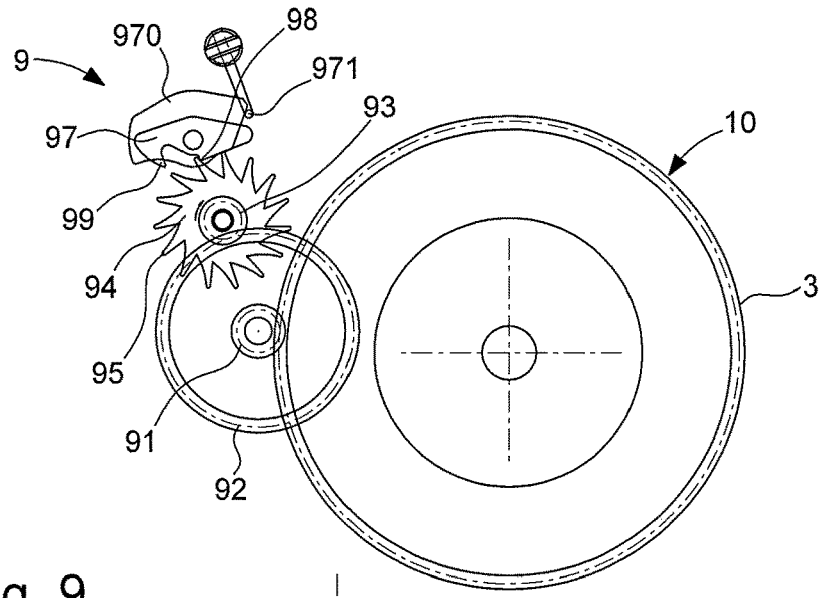
FIG. 8 represents, in a similar manner to FIG. 1, only the area of the regulating mechanism.
Figure 9:
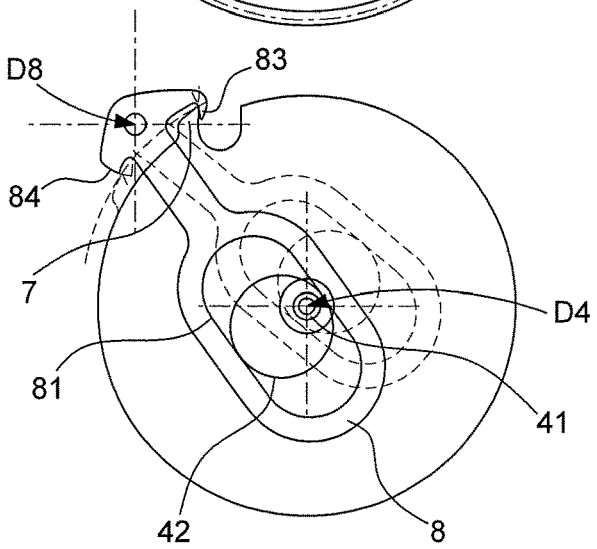
FIG. 9 represents, in a similar manner to FIG. 1, only the area of the drum and anchor piece, which is represented in its extreme angular positions: in a solid line for the afternoon and in a dotted line for the morning.
Figure 10:
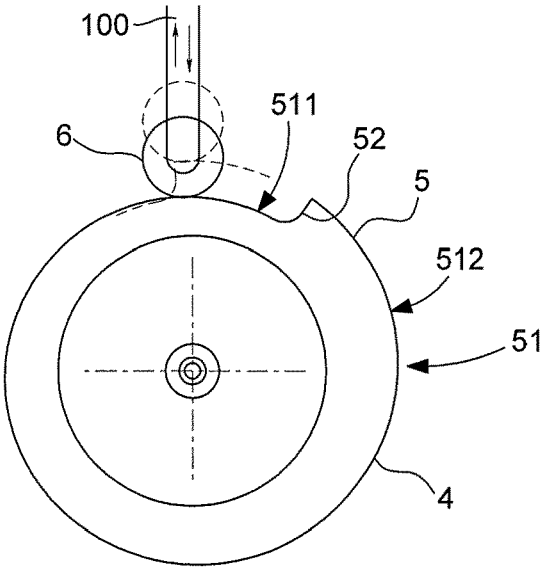
FIG. 10 represents, in a similar manner to FIG. 1, only the area of the cam and runner/feeler controlling the display member.
Figure 11:
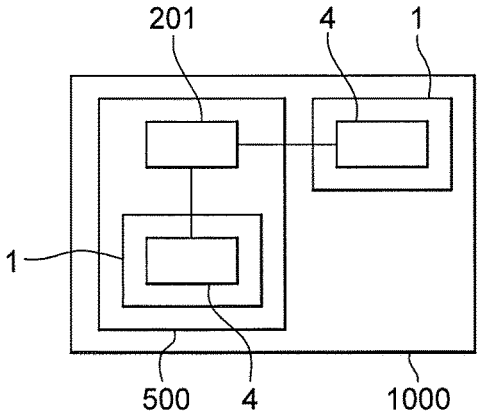
FIG. 11 represents, in a block diagram, a watch comprising a movement, which on the one hand includes a display mechanism according to the invention, and on the other hand drives another display mechanism according to the invention.

FIG. 7 illustrates the state of the system shortly after midnight, at around 00:30. Finger 7 is again abuttingly engaged with stop 84 of anchor piece 8. Eccentric crank pin 52 is still close to second end 812 of oblong groove 81. The runner of feeler 6 has dropped again, from the high position illustrated in dot and dash lines, to its low position resting on lower level 511 of snail 51. The angle βtravelled is that formed between the positions of zero reset threshold 52 in FIGS. 6 and 7.

The invention also concerns a timepiece movement 500 including such a display mechanism 1.

The invention also concerns a timepiece, in particular a clock or a watch 1000, including such a movement 500, and/or such a display mechanism 1.

Variants of the invention are possible.

Actuation at midnight can be achieved using other principles, for example with a biased pinion (constant force type). For example, third wheel set 80 is a star or a pinion integral with an arbor 41 of first wheel set 4.

Another variant forms the reverse configuration to that illustrated by the Figures: the second wheel set 30 is a barrel 3 arranged to be driven by a drive wheel set 201, and which carries the third wheel set 80. First wheel set 4 is then arranged to drive or carry said peripheral snail 51 cam 5.

Regulation can then be ensured by another type of regulating system, of the striking governor type, for example an eddy current governor, or magnetic governor, or electrostatic governor, or otherwise.

The function time, which is defined by the type of regulating mechanism 9 chosen, can be chosen freely, here it is set in a non-limiting manner between 1 and 30 seconds. Indeed, at these speeds, the dynamic stresses produced by speed are negligible, only static stresses are noticeable.

The date jump occurs in such a way as to produces only stresses that can be statically calculated, the dynamic effect linked to the inertia of the components during the jump is negligible.

The jump is considered to occur instantaneously in the context of a day, but remains clearly visible to the user, which gives the impression of quality.

Since the jump is limited to a few seconds, the time limits for date corrections are limited, as are the risks of losing information and operating defects.

The invention claimed is:

1. A timepiece display mechanism comprising at least one display member that moves in jumps, said mechanism including at least one spring between a first wheel set and a second wheel set, said first wheel set or respectively said second wheel set being arranged to be driven by a drive wheel set, wherein said second wheel set or respectively said first wheel set is arranged to drive or carry a peripheral snail cam traversed by a feeler arranged to control the jump of said display member, and wherein said mechanism includes locking/release means including, on the one hand at least one finger driven by said second wheel set or respectively said first wheel set, and on the other hand, a third wheel set arranged, depending on its angular position, to stop or release said at least one finger, to prevent or respectively allow rotation of said cam, characterized in that wherein said third wheel set is an anchor piece angularly movable about an anchor piece axis under the action of said first wheel set or respectively of said second wheel set, said anchor piece being arranged, depending on its angular position, to stop or release said at least one finger, to prevent or respectively allow rotation of said cam.

2. The mechanism according to claim 1, wherein said mechanism includes comprises a regulating mechanism including a regulating train meshing with that of said second wheel set or respectively of said first wheel set which drives or carries said cam, to limit the rotational speed thereof when said finger is released.

3. The mechanism according to claim 1, wherein said at least one spring is wound between an arbor of said wheel set and said second wheel set.

4. The mechanism according to claim 3, wherein said mechanism includes comprises a barrel comprising at least one said spring between, on the one hand one side, the arbor of said barrel, which is integral with said arbor of said first wheel set, or which forms the latter, and on another side the other hand, said drum.

5. The mechanism according to claim 1, wherein said second wheel set is a drum carrying at least one peripheral finger outside the trajectory of said feeler.

6. The mechanism according to claim 1, wherein said first wheel set includes an eccentric crank pin permanently guiding a groove to control the periodic back and forth motions of said pivoting anchor piece, which includes, on either side of said anchor piece axis, a beak and a stop for stopping or releasing said finger depending on the angular position of said anchor piece, the angular travel of each finger between its release by said beak and return to abutment on said stop defining the jump duration.

7. The mechanism according to claim 1, wherein said first wheel set pivots and is driven with an integer gear ratio by said drive wheel set, in that wherein said snail comprises a zero reset threshold after said jump, and wherein the angular travel, relative to the axis of said first wheel set, of each finger between its release by said beak and return to abutment on said stop defines the jump duration which corresponds to the duration of travel of said feeler on said cam, firstly on a ramp that gradually ascends from a lower level to an upper level of said snail and then instantly drops back to said lower level on crossing said zero reset threshold.

8. The mechanism according to claim 1, wherein each jump corresponds to a change of state of said display member between an earlier state and a later state, and to a jump duration corresponding to the period of time that elapses between stable display of said earlier state and stable display of said later state.

9. The mechanism according to claim 1, wherein said first input wheel set is arranged to be driven by said continuous drive wheel set and to complete, during one revolution of said continuous drive wheel set, one revolution or an integer number of turns or a whole fraction of a turn.

10. A display mechanism according to claim 1, wherein said second wheel set is a barrel arranged to be driven by a drive wheel set, and which carries said third wheel set, and in that wherein said first wheel set is arranged to drive or carry said peripheral snail cam.

11. The mechanism according to claim 1, wherein said display member moves in periodic jumps.

12. The mechanism according to claim 1, wherein said display member is a date display member.

13. A timepiece movement comprising a display mechanism according to claim 1.

14. A watch comprising a movement according to claim 13.

* * * * *